US006001518A

United States Patent [19]

Ohsawa et al.

[11] Patent Number: 6,001,518

[45] Date of Patent: Dec. 14, 1999

[54] REVERSIBLE HEAT-SENSITIVE RECORDING MATERIAL WITH HIGH COLOR DEVELOPMENT AND IMAGE STABILIZATION CAPABILITIES

[75] Inventors: Haruhiko Ohsawa; Shin-ichi Koizumi; Hiroyuki Morinaka; Minoru Fujita, all of Tokyo, Japan

[73] Assignee: Kyodo Printing Co., Ltd., Tokyo, Japan

[21] Appl. No.: 09/057,575

[22] Filed: Apr. 9, 1998

[30] Foreign Application Priority Data

Apr. 11, 1997 [JP] Japan ..... 9-094088

[51] Int. Cl.[6] ..... G03C 1/73; G03C 5/56

[52] U.S. Cl. ..... 430/19; 430/338; 430/339; 430/962; 430/964; 346/135.1; 503/204; 503/216; 503/225

[58] Field of Search ..... 430/19, 338, 339, 430/962, 964; 503/204, 216, 225; 346/135.1

[56] References Cited

U.S. PATENT DOCUMENTS

| | | | |
|---|---|---|---|
| 5,296,439 | 3/1994 | Maruyama et al. | 503/201 |
| 5,395,433 | 3/1995 | Maruyama et al. | 106/21 A |
| 5,395,815 | 3/1995 | Ikeda et al. | 503/201 |
| 5,432,534 | 7/1995 | Maruyama et al. | 346/135.1 |
| 5,498,772 | 3/1996 | Maruyama et al. | 503/201 |
| 5,710,094 | 1/1998 | Minami et al. | 503/204 |

FOREIGN PATENT DOCUMENTS

| | | |
|---|---|---|
| 0492628 | 7/1992 | European Pat. Off. . |
| 0574879 | 12/1993 | European Pat. Off. . |
| 0648612 | 4/1995 | European Pat. Off. . |
| 0709225 | 5/1996 | European Pat. Off. . |

OTHER PUBLICATIONS

Patent Abstracts of Japan, vol. 11, No. 54 (M–563).

*Primary Examiner*—Richard L. Schilling
*Attorney, Agent, or Firm*—Greenblum & Bernstein, P.L.C.

[57] ABSTRACT

A reversible heat-sensitive recording medium has a substrate where a reversible heat-sensitive recording layer and a protective layer are successively formed on top of it. The reversible heat-sensitive recording layer is formed by a reversible heat-sensitive recording material including a leuco dye and a color developing/reducing agent. The color developing/reducing agent is a combination of two kinds of color developing/reducing agents, one with a high color developing ability and the other with high image preservation and stabilization capabilities. The two agents are combined at a ratio between 1:4 to 4:1. Thus a reversible heat-sensitive recording material with a fine color developing ability and high image preservation and stabilization capabilities can be obtained.

20 Claims, 1 Drawing Sheet

REVERSIBLE HEAT-SENSITIVE RECORDING MATERIAL WITH HIGH COLOR DEVELOPMENT AND IMAGE STABILIZATION CAPABILITIES

BACKGROUND OF THE INVENTION

1. Field of the Invention

The present invention relates to a reversible heat-sensitive recording material, especially to which causes superior color development and high stabilization of an image.

2. Description of Related Art

Generally, heat-sensitive recording materials are obtained by forming on a substrate a heat-sensitive recording layer composed mainly of a usually colorless or light-colored, electron-donating leuco dye and an electron-accepting developer. On heating with a thermal head, laser beams or the like, the leuco dye and the developer react with each other to give a printed image.

When an image is once formed in such heat-sensitive recording material, it is impossible to erase the image and newly form another image on the spot. Therefore, in order to record further information, there is no choice but to record the information in a part of the heat-sensitive recording material where an image has not been formed. Consequently, while the heat-sensitive recording material is limited in the area of its heat-sensitive recording portion, the amount of information that the material is capable of recording is limited.

On the contrary, there is known a reversible heat-sensitive recording material comprising a leuco dye and an agent used both as developer and tone reducer (it will be referred to as "color developing/reducing agent" in the following) which causes color development or achromatization of the leuco dye on heating. One example of such color developing/reducing agent would be an amphoteric compound having an acidic group capable of allowing the leuco dye to develop a color and a basic group capable of achromatizing the leuco dye thus colored. The color development or the achromatization is carried out by causing the color-developing action of the acidic group or the achromatization action of the basic group, respectively, by controlling the heat energy. This method, however, does not allow complete switching between the color development reaction and the achromatization reaction by virtue of heat energy control alone. Since the two reactions occur at a certain ratio at the same time, sufficient coloring density can not be obtained and complete achromatization can not be executed. Thus sufficient image contrast can not be attained. Another possible disadvantage is that the basic group has achromatizing action also on a colored portion at ordinary temperature, so that the color density of the colored portion is unavoidably decreased with the lapse of time.

On the other hand, other kinds of such color developing/reducing agents have been developed, in which one example would be a phenolic compound or a phthalic acid compound having a long chain alkyl group. However, there is not yet known an agent for both color development and tone reduction which is superior in its ability of coloring and stabilizing an image. On using a color developing/reducing agent which is capable of a high image stability, there would be only a small difference obtained between the color density and the achromatization density because when improving the color density, an insufficient achromatization should be expected. On the other hand, on using a color developing/reducing agent with a high coloring capability, it might happen that the image is erased while being preserved, especially in a humid atmosphere.

SUMMARY OF THE INVENTION

The present invention has been achieved with such points in mind, and it is a main object of the invention to provide a reversible heat-sensitive recording material which proves superior in image stabilization and color development.

With respect to a first aspect of the present invention, there is provided a reversible heat-sensitive recording material comprising a leuco dye and an agent used as both developer and color reducer (a color developing/reducing agent), capable of carrying out reversible color development and achromatization, the color developing/reducing agent being a compound of a color development/reducing agent with a fine color developing ability and a color developing/reducing agent with high image stabilization and preservation capabilities being combined at a ratio between 1:4 to 4:1.

With respect to a second aspect of the invention, there is provided a reversible heat-sensitive recording material according to the first aspect of the invention, wherein the color developing/reducing agent having a fine color developing ability is expressed by the following formula I:

I

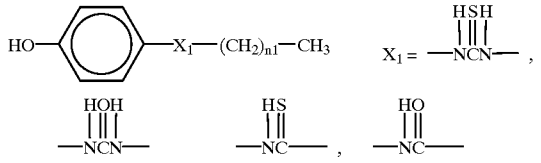

in which n1 is an integer equal to or more than 11.

With respect to a third aspect of the invention, there is provided a reversible heat-sensitive recording material according to the first aspect of the invention, wherein the color developing/reducing agent having a fine color developing ability is expressed by the following formula II:

II

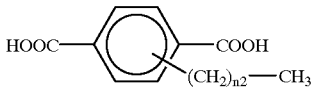

in which n2 is an integer equal to or more than 11.

With respect to a fourth aspect of the invention, there is provided a reversible heat-sensitive recording material according to any of the above aspects of the invention, wherein the color developing/reducing agent having high image preservation and stabilization capabilities is expressed by the following formulas III or IV:

III

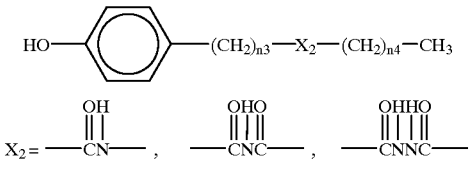

in which n3 equals 0 or 2, and n4 is an integer equal to or more than 11; or

IV

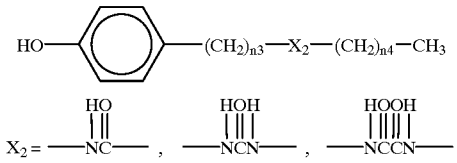

in which n3 equals to 1 or 3, and n4 is an integer equal to or more than 11.

With respect to a fifth aspect of the invention, there is provided a reversible heat-sensitive recording medium having a reversible heat-sensitive recording material which comprises a leuco dye and an agent used as both developer and color reducer (a color developing/reducing agent), capable of carrying out reversible color development and achromatization, the color developing/reducing agent being a compound of a color developing/reducing agent with a fine color developing ability and a color developing/reducing agent with excellent image stabilization and preservation features being combined at a ratio between 1:4 to 4:1.

The above and further objects and the novel feature of the invention will more fully appear from the following detailed description when the same is read in connection with the accompanying drawing. It is to be expressly understood, however, that the drawing is for illustration only and is not intended as a definition of the limits of the invention.

DESCRIPTION OF THE PREFERRED EMBODIMENTS

Figure 1:
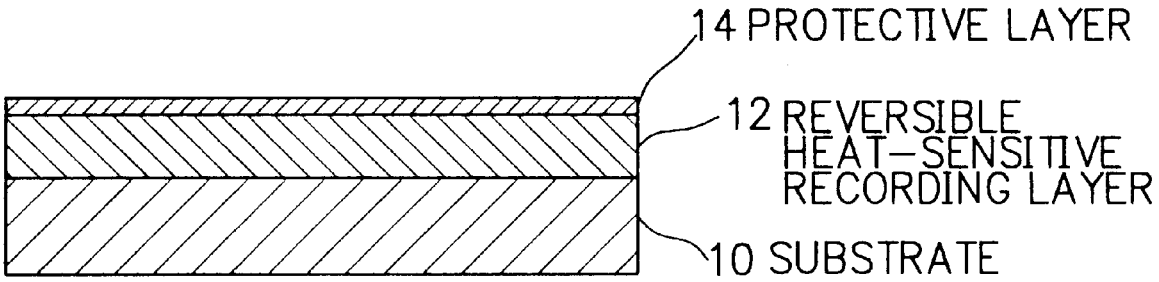
FIG. 1 is a diagram showing one embodiment of the reversible heat-sensitive recording medium of the present invention.

Referring now to a single drawing, a description of a preferred embodiment of the present invention will be given in detail.

FIG. 1 shows one embodiment of the reversible heat-sensitive recording medium of the invention. As illustrated in FIG. 1, the reversible heat-sensitive recording medium is formed in a manner that a substrate layer 10, a reversible heat-sensitive recording layer 12, and a protective layer 14 are put on top of one another, i.e. the protective layer 14 is laminated over the reversible heat-sensitive recording layer 12 while the reversible heat-sensitive recording layer 12 is laminated over the substrate layer 10 placed on the bottom.

The substrate layer 10 serves as a base material of the reversible heat-sensitive recording medium. For such substrate layer, there is used, for example, a polyethylene terephthalate film.

The protective layer 14 is a layer which protects the surface of the reversible heat-sensitive recording medium. The protective layer is made of ultraviolet setting resin, which comprises silica and so forth.

The reversible heat-sensitive recording layer 12 comprises, for instance, a leuco dye, an agent used as both developer and tone reducer (a color development/reducing agent) and a binder resin. It is a layer which repeats reversible color development and achromatization actions on heating. The leuco dye is usually colorless or light-colored and referred to as an electron-donating dye precursor.

The color developing/reducing agent is called an electron-accepting compound, which causes a reversible color tone change of the leuco dye by altering a cooling speed after heating. It is a phenolic compound or a phthalic acid compound including at least one aliphatic hydrocarbon group having six or more carbon atoms. In the present invention, there is employed a color developing/reducing agent which combines a color developing/reducing agent with a fine color developing ability and a color developing/reducing agent with high image preservation and stabilization capabilities at a ratio between 1:4 to 4:1.

With respect to the color developing/reducing agent having a high color developing ability, it is preferable that such agent with a strong acid group is applied, such that a greater portion of the leuco dye included in the reversible heat-sensitive recording layer can react with the agent. It is preferred that the color developing/reducing agent has a melting point of 150° C. The color developing/reducing agent having a superior color developing ability expressed in the following formula I should be employed (note that n1 is an integer equal to or more than 11).

I

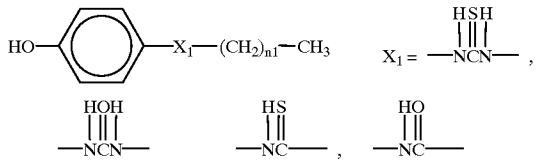

As understood by the above formula, $X_1$ is either thiourea, urea, thioamide, or amide.

Another color dveloping/reducing agent having a superior developing ability is represented by the following formula II (note that n2 is an integer equals to or more than 11).

II

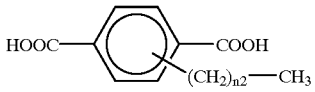

With respect to the color developing/reducing agent having high image preservation and stabilization capabilities, it is preferred that such agent has a melting point over 160° C. This is due to the fact that a mechanism of reversible recording concerns the crystallization of the color developing/reducing agent, and the color developing/reducing agent with a high melting point is preferable while the agent with a low melting point easily enters a melting state because of influences by heat and moisture. The color developing/reducing agent having high image preservation and stabilization capabilities is represented by the following formula III or IV:

III

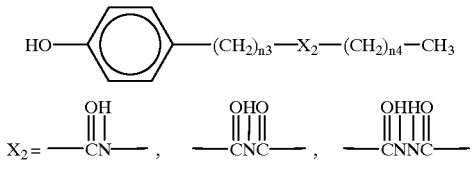

in which n3 equals 0 or 2, n4 is an integer equal to or more than 11, and $X_2$ is either amide (—CONH—), diacylamine, or diacylhydrazine; or

IV

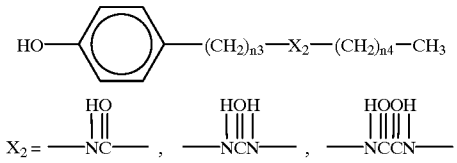

in which n3 is 1 or 3, n4 is an integer equal to or more than 11, and $X_2$ is either amide (—NHCO—), urea, or oxalic-diamide.

In the following, specific examples of preferable color developing/reducing agents, i.e. electron-accepting compounds will be listed.

Examples of the color developing/reducing agent with a superior color developing ability as expressed in formula I include the following thiourea compounds: N-(p-hydroxyphenyl)-N'-n-dodecylthiourea, N-(p-hydroxyphenyl)-N'-n-tridecylthiourea, N-(p-hydroxyphenyl)-N'-n-tetradecylthiourea, N-(p-hydroxyphenyl)-N'-n-pentadecylthiourea, N-(p-hydroxyphenyl)-N'-n-hexadecylthiourea, N-(p-hydroxyphenyl)-N'-n-heptadecylthiourea, N-(p-hydroxyphenyl)-N'-n-octadecylthiourea, N-(p-hydroxyphenyl)-N'-n-nonadecylthiourea, N-(p-hydroxyphenyl)-N'-n-icosylthiourea, N-(p-hydroxyphenyl)-N'-n-henicosylthiourea, and N-(p-hydroxyphenyl)-N'-n-docosylthiourea.

With respect to the color developing/reducing agent with a high color developing ability as expressed in formula I, there are the following urea compounds: N-(p-hydroxyphenyl)-N'-n-dodecylurea, N-(p-hydroxyphenyl)-N'-n-tridecylurea, N-(p-hydroxyphenyl)-N'-n-tetradecylurea, N-(p-hydroxyphenyl)-N'-n-pentadecylurea, N-(p-hydroxyphenyl)-N'-n-hexadecylurea, N-(p-hydroxyphenyl)-N'-n-heptadecylurea, N-(p-hydroxyphenyl)-N'-n-octadecylurea, N-(p-hydroxyphenyl)-N'-n-nonadecylurea, N-(p-hydroxyphenyl)-N'-n-icosylurea, N-(p-hydroxyphenyl)-N'-n-henicosylurea, and N-(p-hydroxyphenyl)-N'-n-docosylurea.

Examples of the color developing/reducing agent with a superior color developing ability as expressed in formula I include the following thioamide compounds: N-(p-hydroxyphenyl)-N'-n-dodecylthioamide, N-(p-hydroxyphenyl)-N'-n-tridecylthioamide, N-(p-hydroxyphenyl)-N'-n-tetradecylthioamide, N-(p-hydroxyphenyl)-N'-n-pentadecylthioamide, N-(p-hydroxyphenyl)-N'-n-hexadecylthioamide, N-(p-hydroxyphenyl)-N'-n-heptadecylthioamide, N-(p-hydroxyphenyl)-N'-n-octadecylthioamide, N-(p-hydroxyphenyl)-N'-n-nonadecylthio-amide, N-(p-hydroxyphenyl)-N'-n-icosylthioamide, N-(p-hydroxyphenyl)-N'-n-henicosylthioamide, and N-(p-hydroxyphenyl)-N'-n-docosylthioamide.

With respect to the color developing/reducing agent with a superior color developing ability as expressed in formula I there are the following amide compounds:4'-hydroxytridecananilide, 4'-hydroxytetradecananilide, 4'-hydroxypentadecananilide, 4'-hydroxyhexadecananilide, 4'-hydroxyheptadecananilide, 4'-hydroxyoctadecananilide, 4'-hydroxynonadecananilide, 4'-hydroxyicosananilide, 4'-hydroxyhenicosananilide, and 4'-hydroxydocosananilide.

Some specific examples for the aforementioned formula II, the following are in hand:2-dodecylterephthalic acid, 2-tridecylterephthalic acid, 2-tetradecylterephthalic acid, 2-pentadecylterephthalic acid, 2-hexadecylterephthalic acid, 2-heptadecylterephthalic acid, 2-octadecylterephthalic acid, 2-nonadecylterephthalic acid, 2-icosylterephthalic acid, 2-henicosylterephthalic acid, and 2-docosylterephthalic acid.

Examples of the color developing/reducing agent with high image preservation and stabilization capabilities as expressed in formula III, where n3 is 0 or 2, include the following amide compounds: N-dodecyl(p-hydroxyphenyl) amide, N-tridecyl(p-hydroxyphenyl)amide, N-tetradecyl(p-hydroxyphenyl)amide, N-pentadecyl(p-hydroxyphenyl) amide, N-hexadecyl(p-hydroxyphenyl)amide, N-heptadecyl (p-hydroxyphenyl)amide, N-octadecyl(p-hydroxyphenyl) amide, N-nonadecyl(p-hydroxyphenyl)amide, N-icosyl(p-hydroxyphenyl)amide, N-henicosyl(p-hydroxyphenyl) amide, N-docosyl(p-hydroxyphenyl)amide, N-dodecyl[2-(p-hydroxyphenyl)ethyl]amide, N-tridecyl[2-(p-hydroxyphenyl)ethyl]amide, N-tetradecyl[2-(p-hydroxyphenyl)ethyl]amide, N-pentadecyl[2-(p-hydroxyphenyl) ethyl]amide, N-hexadecyl[2-(p-hydroxyphenyl)ethyl]amide, N-heptadecyl[2-(p-hydroxyphenyl)ethyl]amide, N-octadecyl[2-(p-hydroxyphenyl)ethyl]amide, N-nonadecyl[2-(p-hydroxyphenyl) ethyl]amide, N-icosyl[2-(p-hydroxyphenyl) ethyl]amide, N-henicosyl[2-(p-hydroxyphenyl)ethyl]amide, and N-docosyl[2-(p-hydroxyphenyl)ethyl]amide.

Examples of the color developing/reducing agent with high image preservation and stabilization capabilities as expressed in formula III, where n3 is 0 or 2, include the following diacylamine compounds: N-(p-hydroxybenzoyl)-N-tridecanoylamine, N-(p-hydroxybenzoyl)-N-tetradecanoylamine, N-(p-hydroxybenzoyl)-N-pentadecanoylamine, N-(p-hydroxybenzoyl)-N-hexadecanoylamine, N-(p-hydroxybenzoyl)-N-heptacanoylamine, N-(p-hydroxybenzoyl)-N-octadecanoylamine, N-(p-hydroxybenzoyl)-N-nonadecanoylamine, N-(p-hydroxybenzoyl)-N-icosanoylamine, N-(p-hydroxybenzoyl)-N-henicosanoylamine, and N-(p-hydroxybenzoyl)-N-docosanoylamine.

Examples of the color developing/reducing agent with high image preservation and stabilization capabilities as expressed in formula III, where n3 is 0 or 2, include the following diacylhydrazine compounds: N-[3-(p-hydroxyphenyl) propiono]-N'-tridecanohydrazide, N-[3-(p-hydroxyphenyl) propiono]-N'-tetradecanohydrazide, N-[3-(p-hydroxyphenyl) propiono]-N'-pentadecanohydrazide, N-[3-(p-hydroxyphenyl) propiono]-N'-hexadecanohydrazide, N-[3-(p-hydroxyphenyl) propiono]-N'-heptadecanohydrazide, N-[3-(p-hydroxyphenyl) propiono]-N'-octadecanohydrazide, N-[3-(p-hydroxyphenyl) propiono]-N'-nonadecanohydrazide, N-[3-(p-hydroxyphenyl) propiono]-N'-icosanohydrazide, N-[3-(p-hydroxyphenyl) propiono]-N'-henicosanohydrazide, and N-[3-(p-hydroxyphenyl) propiono]-N'-docosanohydrazide.

Examples of the color developing/reducing agent with high image preservation and stabilization capabilities as expressed in formula IV, where n3 is 1 or 3, include the following amide compounds: N-[(p-hydroxyphenyl) methyl]-n-dodecylamide, N-[(p-hydroxyphenyl)methyl]-n-tridecylamide, N-[(p-hydroxyphenyl)methyl]-n-tetradecylamide, N-[(p-hydroxyphenyl)methyl]-n-pentadecylamide, N-[(p-hydroxyphenyl)methyl]-n-hexadecylamide, N-[(p-hydroxyphenyl)methyl]-n-heptadecylamide, N-[(p-hydroxyphenyl)methyl]-n-octadecylamide, N-[(p-hydroxyphenyl)methyl]-n-nonadecylamide, N-[(p-hydroxyphenyl)methyl]-n-icosylamide, N-[(p-hydroxyphenyl)methyl]-n-henicosylamide, N-[(p-hydroxyphenyl)methyl]-n-docosylamide, N-[3-(p-hydroxyphenyl)propyl]-n-dodecylamide, N-[3-(p-hydroxyphenyl)propyl]-n-tridecylamide, N-[3-(p-hydroxyphenyl)propyl]-n-tetradecylamide, N-[3-(p-hydroxyphenyl)propyl]-n-pentadecylamide, N-[3-(p-hydroxyphenyl)propyl]-n-hexadecylamide, N-[3-(p-hydroxyphenyl)propyl]-n-heptadecylamide, N-[3-(p-hydroxyphenyl)propyl]-n-octadecylamide, N-[3-(p-hydroxyphenyl)propyl]-n-nonadecylamide, N-[3-(p-hydroxyphenyl)propyl]-n-icosylamide, N-[3-(p-hydroxyphenyl)propyl]-n-henicosylamide, and N-[3-(p-hydroxyphenyl)propyl]-n-docosylamide.

Examples of the color developing/reducing agent with high image preservation and stabilization capabilities as expressed in formula IV, where n3 is 1 or 3, include the following urea compounds: N-[(p-hydroxyphenyl)methyl]-N'-n-dodecylurea, N-[(p-hydroxyphenyl)methyl]-N'-n-tridecylurea, N-[(p-hydroxyphenyl)methyl]-N'-n-tetradecylurea, N-[(p-hydroxyphenyl)methyl]-N'-n-pentadecylurea, N-[(p-hydroxyphenyl)methyl]-N'-n-hexadecylurea, N-[(p-hydroxyphenyl)methyl]-N'-n-heptadecylurea, N-[(p-hydroxyphenyl)methyl]-N'-n-octadecylurea, N-[(p-hydroxyphenyl)methyl]-N'-n-nonadecylurea, N-[(p-hydroxyphenyl)methyl]-N'-n-icosylurea, N-[(p-hydroxyphenyl)methyl]-N'-n-henicosylurea, N-[(p-hydroxyphenyl)methyl]-N'-n-docosylurea, N-[3-(p-hydroxyphenyl)propyl]-N'-n-dodecylurea, N-[3-(p-hydroxyphenyl)propyl]-N'-n-tridecylurea, N-[3-(p-hydroxyphenyl)propyl]-N'-n-tetradecylurea, N-[3-(p-hydroxyphenyl)propyl]-N'-n-pentadecylurea, N-[3-(p-hydroxyphenyl)propyl]-N'-n-hexadecylurea, N-[3-(p-hydroxyphenyl)propyl]-N'-n-heptadecylurea, N-[3-(p-hydroxyphenyl)propyl]-N'-n-octadecylurea, N-[3-(p-hydroxyphenyl)propyl]-N'-n-nonadecylurea, N-[3-(p-hydroxyphenyl)propyl]-N'-n-icosylurea, N-[3-(p-hydroxyphenyl)propyl]-N'-n-henicosylurea, and N-[3-(p-hydroxyphenyl)propyl]-N'-n-docosylurea.

Examples of the color developing/reducing agent with high image preservation and stabilization capabilities as expressed in formula IV, where n3 is 1 or 3, include the following oxalic-diamide compounds: N-[(p-hydroxyphenyl)methyl]-N'-n-dodecyloxamide, N-[(p-hydroxyphenyl)methyl]-N'-n-tridecyloxamide, N-[(p-hydroxyphenyl)methyl]-N'-n-tetradecyloxamide, N-[(p-hydroxyphenyl)methyl]-N'-n-pentadecyloxamide, N-[(p-hydroxyphenyl)methyl]-N'-n-hexadecyloxamide, N-[(p-hydroxyphenyl)methyl]-N'-n-heptadecyloxamide, N-[(p-hydroxyphenyl)methyl]-N'-n-octadecyloxamide, N-[(p-hydroxyphenyl)methyl]-N'-n-nonadecyloxamide, N-[(p-hydroxyphenyl)methyl]-N'-n-icosyloxamide, N-[(p-hydroxyphenyl)methyl]-N'-n-henicosyloxamide, N-[(p-hydroxyphenyl)methyl]-N'-n-docosyloxamide, N-[3-(p-hydroxyphenyl)propyl]-N'-n-dodecyloxamide, N-[3-(p-hydroxyphenyl)propyl]-N'-n-tridecyloxamide, N-[3-(p-hydroxyphenyl)propyl]-N'-n-tetradecyloxamide, N-[3-(p-hydroxyphenyl)propyl]-N'-n-pentadecyloxamide, N-[3-(p-hydroxyphenyl)propyl]-N'-n-hexadecyloxamide, N-[3-(p-hydroxyphenyl)propyl]-N'-n-heptadecyloxamide, N-[3-(p-hydroxyphenyl)propyl]-N'-n-octadecyloxamide, N-[3-(p-hydroxyphenyl)propyl]-N'-n-nonadecyloxamide, N-[3-(p-hydroxyphenyl)propyl]-N'-n-icosyloxamide, N-[3-(p-hydroxyphenyl)propyl]-N'-n-henicosyloxamide, and N-[3-(p-hydroxyphenyl)propyl]-N'-n-docosyloxamide.

The leuco dye (electron-donating dye precursor) used in the present invention is usually represented by those used in pressure-sensible recording paper, thermosensible recording paper, light and pressure sensible recording paper, electro-thermosensible recording paper, trans-thermo recording paper, etc. but is not particularly limited. Specific examples of the leuco dye are given below while they are not intended in any way to limit the scope of the present invention.

1) Triarylmethane type compounds 3,3-bis(p-dimethylaminophenyl)-6-dimethylaminophthalide (Crystal Violet lactone), 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis(1,2-dimethylindol-3-yl)-5-dimethylaminophthalide, 3, 3-bis(1,2-dimethylindol-3-yl)-6-dimethylaminophthalide, 3, 3-bis(9-ethylcarbazol-3-yl)-5-dimethylaminophthalide, 3,3-bis(2-phenylindol-3-yl)-5-dimethylaminophthalide, 3p-dimethylaminophenyl-3-(1-methylpyrrol-2-yl)-6-dimethylaminophthalide, etc.

2) Diphenylmethane type compounds 4,4'-bis(dimethylaminophenyl)benzhydryl benzyl ether, N-chlorophenylleucoauramine, N-2,4,5-trichlorophenylleucoauramine, etc.

3) Xanthene type compounds

Rhodamine B anilinolactam, Rhodamine B-p-chloroanilinolactam, 3-diethylamino-7-dibenzylaminofluoran, 3-diethylamino-7-octylaminofluoran, 3-diethylamino-7-phenylfluoran, 3-diethylamino-7-chlorofluoran, 3-diethylamino-6-chloro-7-methylfluoran, 3-diethylamino-7-(3,4-dichloroanilino)fluoran, 3-diethylamino-7-(2-chloroanilino)fluoran, 3-diethylamino-6-methyl-7-anilinofluoran, 3-(N-ethyl-N-tolyl)amino-6-methyl-7-anilinofluoran, 3-piperidino-6-methyl-7-anilinofluoran, 3-(N-ethyl-N-tolyl)amino-6-methyl-7-phenethylfluoran, 3-diethylamino-7-(4-nitroanilino)fluoran, 3-dibutylamino-6-methyl-7-anilinofluoran, 3-(N-methyl-N-propyl)amino-6-methyl-7-anilinofluoran, 3-(N-ethyl-N-isoamyl)amino- 6-methyl-7-anilinofluoran, 3-(N-methyl-N-cyclohexyl)amino-6-methyl-7-anilinofluoran, 3-(N-ethyl-N-tetrahydrofuryl)amino-6-methyl-7-anilinofluoran, etc.

4) Thiazine type compounds

Benzoylleucomethylene blue, p-nitrobenzoylleucomethylene blue, etc.

5) Spiro-compounds 3-methylspirodinaphthopyran, 3-ethylspirodinaphthopyran, 3,3-dichlorospirodinaphthopyran, 3-benzylspirodinaphthopyran, 3-methylnaphtho-(3-methoxybenzo) spiropyran, 3-propylspirobenzopyran, etc.

The above-described leuco dye may be used singly or as a mixture of two or more thereof.

With respect to a binder resin, specific examples are water-soluble macromolecules such as starches, hydroxyethyl cellulose, methyl cellulose, carboxymethyl cellulose, gelatin, casein, polyvinyl alcohols, modified polyvinyl alcohols, sodium polyacrylates, acrylamide-acrylic ester copolymers, acrylamide-acrylic ester-methacrylic ester terpolymers, alkali salts of styrene-maleic anhydride copolymers, alkali salts of styrene-maleic anhydride copolymers, alkali salts of ethylene-maleic anhydride copolymers, etc.; and latices of polyvinyl acetates, polyurethanes, polyacrylic esters, styrene-butadiene copolymers, acrylonitrile-butadiene copolymers, etc.

A binder resin may be incorporated into the reversible heat-sensitive recording layer such that the reversible heat-sensitive recording layer is capable of superior dispersing of the leuco dye and the color developing/reducing agent, thus becoming durable against rewrite actions. Therefore, it is possible to apply double bonding within molecules of the heat reversible resin to achieve an ultraviolet setting or electron beam setting resin.

Specifically, it is possible to obtain a resin where acrylic acid and methacrylic acid are ester-polymerized to vinyl chloride-vinyl acetate-vinyl alcohol copolymers.

In order to carry out color development, heating followed by rapid cooling is sufficient. On the other hand, slow cooling after the heating causes the achromatization. When heating (with an appropriate heat source such as a thermal head, laser beams, heat roll, heating stamp, high-frequency heater, hot air, electric heater, radiant heat from a light source such as a halogen lamp, etc.) takes place for a comparatively long period of time, slow cooling will follow causing a state of phase separation, i.e. a state of achromatization, of the leuco dye and the color developing reducing agent. This slow cooling is due to the substrate having been heated along with the recording layer. On the other hand, by causing rapid cooling after heating, by pressing a low temperature metal body and such, it is possible to bring about a color development. Further, when heating (with a thermal head, laser beam etc.) takes place for an extremely short period of time, cooling (solidifying) will instantly follow after completion of heating, thus causing a state of mixture (color development) of the leuco dye and the color dveloping/reducing agent. Therefore, with the application of the same heat source, color development and achromatization can be carried out arbitrary by controlling the cooling speed.

According to the present embodiment, the reversible heat-sensitive recording layer 12 is formed with two kinds of color developing/reducing agents, one with a superior color developing ability and the other with high image preservation and stabilization capabilities. Accordingly, the layer is capable of providing superior color development, image preservation and stabilization.

The present invention is illustrated in further detail with the following examples.

EXAMPLE 1

A reversible heat-sensitive recording layer is formed on a substrate which is a white PET film having a thickness of 188 μm.

A coating fluid for a reversible heat-sensitive recording layer is formed with a leuco dye, a color developing/reducing agent, a resin and a solvent wherein: a leuco dye is one weight part of 3-diethylamino-6-methyl-7-anilinofluoran, which is a product called ODB manufactured by Yamamoto Chemicals, Inc.; a color producing/reducing agent is a combination of a color producing/reducing agent (1) with a high color developing ability, i.e. monoctadecyl terephthalate, and a color producing/reducing agent (2) with high image preservation and stabilization capabilities, i.e. N-[3-(4-hydroxyphenyl)-N'-n-octadecanohydrazide, the two agents combined at a ratio of 3:1, giving a total of 4 weight parts; a resin is 4 wight parts of a thermoplastic acrylic resin, which is a product called BR-80 manufactured by Mitsubishi Rayon Co. Ltd.; and a solvent is 50 weight parts of a toluene.

The above coating fluid for the reversible heat-sensitive recording layer is put in a container where it is mixed with 2 mm ϕ of zirconia beads and dispersed by a paint shaker for an hour. The resultant fluid is applied on the substrate by a wire bar and dried for five minutes at 80° C., eventually forming a reversible heat-sensitive recording layer having a dried coating thickness of 6 μm.

Next, a protective layer is formed on a reversible heat-sensitive recording layer with the application of a coating fluid for a protective layer described bellow.

A coating fluid for a protective layer is an ultraviolet setting type acrylic coating, which is a product called C3-374 -(NV. 75%) manufactured by Dainippon Ink & Chemicals, Inc.

This coating fluid for a protective layer is applied on a reversible heat-sensitive recording layer by a wire bar, dried for a minute at 80° C., and irradiated by a 160 W/cm ultraviolet layer at a speed of 30 m/sec to be harden. This will result in giving a protective layer having a dried coating thickness of 2 μm.

EXAMPLE 2

This example is practically the same as Example 1, except that the color developing/reducing agents (1) and (2) are combined at a 2:2 ratio.

EXAMPLE 3

This example is practically the same as Example 1, except that the color developing/reducing agents (1) and (2) are combined at a 1:3 ratio.

COMPARATIVE EXAMPLE 1

In the same conditions provided in Example 1, the color developing/reducing agents (1) and (2) are combined at a 4:0 ratio, i.e. only the color developing/reducing agent (1) is used.

COMPARATIVE EXAMPLE 2

In the same conditions provided in Example 1, the color developing/reducing agents (1) and (2) are combined at a 0:4 ratio, i.e. only the color developing/reducing agent (2) is used.

EXAMPLE 4

This example is basically the same as Example 1, except that a color developing/reducing agent (3) with a high color developing ability and a color developing/reducing agent (2) with high image preservation and stabilization capabilities are used instead of the color developing/reducing agents (1) and (2). The color developing/reducing agent (3) is N-(4-hydroxyphenyl)-N'-n-octadecylurea, and the color developing/reducing agent (2) is N-[3-(4-hydroxyphenyl)-N'-n-octadecanohydrazide. The two agents (3) and (2) are combined at a 3:1 ratio, providing a total of 4 weight parts.

EXAMPLE 5

This example is practically the same as Example 4, except that the color developing/reducing agents (3) and (2) are combined at a 2:2 ratio.

EXAMPLE 6

This example is practically the same as Example 4, except that the color developing/reducing agents (3) and (2) are combined at a 1:3 ratio.

COMPARATIVE EXAMPLE 3

In the same conditions provided in Example 4, the color developing/reducing agents (3) and (2) are combined at a 4:0 ratio, i.e. only the color developing/reducing agent (3) is used.

COMPARATIVE EXAMPLE 4

In the same conditions provided in Example 4. the color developing/reducing agents (3) and (2) are combined at a 0:4 ratio, i.e. only the color developing/reducing agent (2) is used.

A series of tests are conducted with the heat-sensitive recording materials obtained in Examples 1 to 3 and Comparative Examples 1 and 2 for their color developing ability, and image preservation and stabilization capabilities. The results obtained are shown in Table 1.

portion after both the temperature-humidity resistance test and the light resistance test are sufficient. On the other hand, Comparative Example 1 proves satisfactory color density for both a printed portion and an erased portion while a survival rate of a printed portion after the temperature-humidity resistance test is greatly deficient. As to Comparative Example 2, survival rates of a printed portion after both the temperature-humidity resistance test and the light resistance test are appropriate, but the color density of a printed portion is insufficient.

TABLE 1

| | MIX RATIO OF AGENT(1) & AGENT(2) (1):(2) | INITIAL STATE GROUND DENSITY | INITIAL STATE COLOR DENSITY OF PRINTED PORTION | INITIAL STATE COLOR DENSITY OF ERASED PORTION | AFTER TEMPERATURE-HUMIDITY RESISTANCE TEST GROUND DENSITY | AFTER TEMPERATURE-HUMIDITY RESISTANCE TEST SURVIVAL COLOR DENSITY | AFTER LIGHT RESISTANCE TEST GROUND DENSITY | AFTER LIGHT RESISTANCE TEST SURVIVAL COLOR DENSITY | EVALUATION |
|---|---|---|---|---|---|---|---|---|---|
| EXAMPLE 1 | 3:1 | 0.18 | 0.90 | 0.23 | 0.18 | 0.72 | 0.24 | 0.75 | ◎ |
| EXAMPLE 2 | 2:2 | 0.15 | 0.83 | 0.20 | 0.16 | 0.74 | 0.20 | 0.80 | ◎ |
| EXAMPLE 3 | 1:3 | 0.11 | 0.77 | 0.17 | 0.12 | 0.73 | 0.14 | 0.76 | ◎ |
| COMPARATIVE EXAMPLE 1 | 4:0 | 0.21 | 1.00 | 0.30 | 0.20 | 0.27 | 0.25 | 0.72 | Δ |
| COMPARATIVE EXAMPLE 2 | 0:4 | 0.06 | 0.69 | 0.07 | 0.06 | 0.68 | 0.07 | 0.69 | ○ |

Likewise, a series of tests are conducted with the heat-sensitive recording materials obtained in the Examples 4 to 6 and Comparative Examples 3 and 4 for their color developing ability, and image preservation and stabilization capabilities. The results obtained are shown in Table 2.

What can be concluded from the test results presented in Table 1 is that when combining the color developing/reducing agents (1) and (2) at either 3:1 or 1:3 ratio, the color density of a printed portion and that of an erased portion are satisfactory and those combinations have good durability

TABLE 2

| | MIX RATIO OF AGENT(3) & AGENT(2) (3):(2) | INITIAL STATE GROUND DENSITY | INITIAL STATE COLOR DENSITY OF PRINTED PORTION | INITIAL STATE COLOR DENSITY OF ERASED PORTION | AFTER TEMPERATURE-HUMIDITY RESISTANCE TEST GROUND DENSITY | AFTER TEMPERATURE-HUMIDITY RESISTANCE TEST SURVIVAL COLOR DENSITY | AFTER LIGHT RESISTANCE TEST GROUND DENSITY | AFTER LIGHT RESISTANCE TEST SURVIVAL COLOR DENSITY | EVALUATION |
|---|---|---|---|---|---|---|---|---|---|
| EXAMPLE 3 | 3:1 | 0.06 | 1.03 | 0.06 | 0.07 | 0.83 | 0.11 | 0.99 | ◎ |
| EXAMPLE 4 | 2:2 | 0.08 | 0.87 | 0.08 | 0.08 | 0.82 | 0.10 | 0.86 | ◎ |
| EXAMPLE 5 | 1:3 | 0.07 | 0.78 | 0.07 | 0.07 | 0.75 | 0.08 | 0.78 | ◎ |
| COMPARATIVE EXAMPLE 3 | 4:0 | 0.06 | 1.10 | 0.06 | 0.07 | 0.31 | 0.23 | 1.04 | Δ |
| COMPARATIVE EXAMPLE 4 | 0:4 | 0.06 | 0.69 | 0.07 | 0.06 | 0.68 | 0.07 | 0.69 | ○ |

The tests, giving the above results in Tables 1 and 2, are conducted in the following conditions: printing is carried out with a print energy of 0.5 mJ/dot with an application of a 8 dot/mm thermal head; erasing is carried out by a hot plate application at 110° C., 1 kg/cm$^2$, for 3 seconds; a color density is measured by a densitometer Macbeth RD-918; a temperature-humidity resistance of a printed portion is measured by leaving the reversible heat-sensitive material in an atmosphere of 40° C. and 90% R.H. for 24 hours; and a light resistance of a printed portion is measured by illuminating the reversible heat-resistance material with a 3000 lux fluorescent light for 24 hours.

As can be observed in Table 1, with respect to Examples 1 to 3, the color density of a printed portion and that of an erased portion are satisfactory, and survival rates of a printed with respect to both the temperature-humidity resistance tests and light resistance test. On the contrary, the application of a single color developing/reducing agent, (1) or (2) causes an inadequate result with respect to one of the mentioned four factors. This suggests that the color dveloping/reducing agents (1) and (2) should be combined in order to obtain sufficient color development, and preservation and stabilization of a printed image.

Now referring to Table 2, with respect to Examples 4 to 6, the color density of a printed portion and that of an erased portion are satisfactory, and survival rates of a printed portion after both the temperature-humidity resistance test and the light resistance test are sufficient.

On the other hand, Comparative Example 3 proves satisfactory color density for both a printed portion and an erased portion while a survival rate of a printed portion after the temperature-humidity resistance test is greatly deficient. As to Comparative Example 4, survival rates of a printed portion after both the temperature-humidity resistance test and the light resistance test are appropriate, but the color density of a printed portion is insufficient.

What can be observed from the test results presented in Table 2 is that when combining the color developing/reducing agents (3) and (2) at either 3:1 or 1:3 ratio, the color density of a printed portion and that of an erased portion are satisfactory and those combinations have good durability against both the temperature-humidity resistance tests and light resistance test. On the contrary, the application of a single color developing/reducing agent, (3) or (2) causes an inadequate result with respect to one of the mentioned four factors. This suggests that the color dveloping/reducing agents (3) and (2) should be combined in order to obtain sufficient color development and preservation and stabilization of a printed image.

In conclusion, according to the present invention, a reversible heat-sensitive recording material superior with respect to color development and image preservation and stabilization can be achieved for two kinds of color development/reducing agents, one with a fine color developing ability and the other with high image preservation and stabilization capabilities, are combined at a ratio between 1:4 to 4:1.

While a preferred embodiment of the invention has been described using specific terms, such description is for illustrative purposes only, and it is to be understood that changes and variations may be made without departing from the spirit or the scope of the following claims.

What is claimed is:

1. A reversible heat-sensitive recording material comprising a leuco dye and an agent which acts both as a color developing and reducing agent, which is capable of reversible color development and achromatization, the color developing and reducing agent comprising:

1) a color developing/reducing agent having the formula:

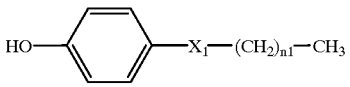

wherein

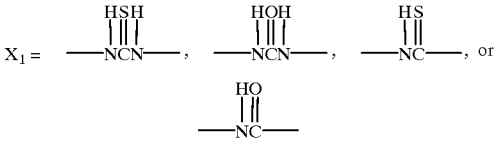

and n1 is an integer equal to or greater than 11; and 2) a color developing agent having the formula:

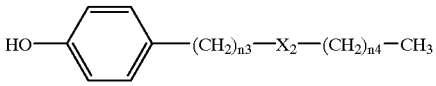

wherein

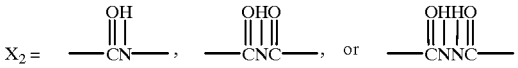

and n3 equals 0 or 2, and n4 is an integer equal to or greater than 11; or having the formula:

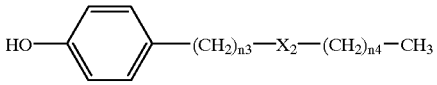

wherein

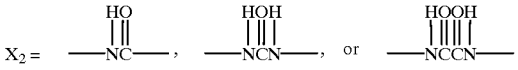

and n3 equals 1 or 3, and n4 is an integer equal to or greater than 11;

and wherein the ratio of 1):2) is from 1:4 to 4:1.

2. The reversible heat-sensitive recording material of claim 1, wherein the ratio of 1):2) is from 1:3 to 3:1.

3. The reversible heat-sensitive recording material of claim 2, wherein the ratio of 1):2) is 1:1.

4. The reversible heat-sensitive recording material of claim 1, wherein the color developing reducing agent 1) comprises N-[3-(4-hydroxyphenyl)-N'-n-octadecylurea.

5. The reversible heat-sensitive recording material of claim 1, wherein the color developing agent 2) comprises N-[3-(4-hydroxyphenyl)-N'-n-octadecanohydrazide.

6. The reversible heat-sensitive recording material of claim 1, wherein the leuco dye comprises 3-diethylamino-6-methyl-7-anilinofluoran.

7. The reversible heat-sensitive recording material of claim 1, wherein the color developing reducing agent 1) comprises N-[3-(4-hydroxyphenyl)-N'-n-octadecylurea, the color developing agent 2) comprises N-[3-(4-hydroxyphenyl)-N'-n-octadeconohydrazide, and the leuco dye comprises 3-diethylamino-6-methyl-7-anilinofluoran.

8. The reversible heat-sensitive recording material of claim 1, wherein the color developing reducing agent 1) has a melting point of 150° C.

9. The reversible heat-sensitive recording material of claim 1, wherein the color developing agent 2) has a melting point of at least 160° C.

10. A recording medium comprising a substrate and the reversible heat-sensitive recording material of claim 1.

11. A reversible heat-sensitive recording material comprising a leuco dye and an agent which acts both as a color developing and reducing agent, which is capable of reversible color development and achromatization, the color developing and reducing agent comprising:

1) a color developing/reducing agent having the formula:

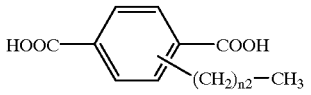

wherein n2 is an integer equal to or greater than 11; and 2) a color developing agent having the formula:

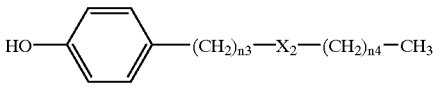

wherein

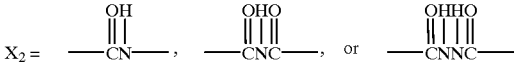

and n3 equals 0 or 2, and n4 is an integer equal to or greater than 11; or having the formula:

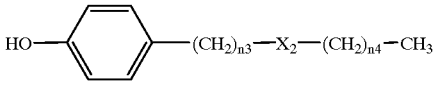

wherein

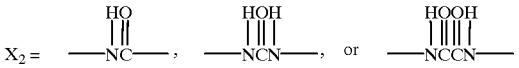

and n3 equals 1 or 3, and n4 is an integer equal to or greater than 11;

and wherein the ratio of 1):2) is from 1:4 to 4:1.

12. The reversible heat-sensitive recording material of claim 11, wherein the ratio of 1):2) is from 1:3 to 3:1.

13. The reversible heat-sensitive recording material of claim 12, wherein the ratio of 1):2) is 1:1.

14. The reversible heat-sensitive recording material of claim 11, wherein the color developing reducing agent 1) comprises monoctadecyl terephthalate.

15. The reversible heat-sensitive recording material of claim 11, wherein the color developing agent 2) comprises N-[3-(4-hydroxyphenyl)-N'-n-octadecanohydrazide.

16. The reversible heat-sensitive recording material of claim 11, wherein the leuco dye comprises 3-diethylamino-6-methyl-7-anilinofluoran.

17. The reversible heat-sensitive recording material of claim 11, wherein the color developing reducing agent 1) comprises monoctadecyl terephthalate, the color developing agent 2) comprises N-[3-(4-hydroxyphenyl)-N'-n-octadecanohydrazide, and the leuco dye comprises 3-diethylamino-6-methyl-7-anilinofluoran.

18. The reversible heat-sensitive recording material of claim 11, wherein the color developing reducing agent 1) has a melting point of 150° C.

19. The reversible heat-sensitive recording material of claim 11, wherein the color developing agent 2) has a melting point of at least 160° C.

20. A recording medium comprising a substrate and the reversible heat-sensitive recording material of claim 11.

* * * * *